73-151 SR
1/25/83 OR 4,369,654

United States Patent [19]
Hallmark

[11] 4,369,654
[45] Jan. 25, 1983

[54] SELECTIVE EARTH FORMATION TESTING THROUGH WELL CASING

[76] Inventor: Bobby J. Hallmark, 158 Afton Rd., Fort Worth, Tex. 76134

[21] Appl. No.: 219,865

[22] Filed: Dec. 23, 1980

[51] Int. Cl.[3] ..... E21B 49/00
[52] U.S. Cl. ..... 73/151
[58] Field of Search ..... 73/151; 166/55, 55.1, 166/250, 297

[56] References Cited

U.S. PATENT DOCUMENTS 3,212,576 10/1965 Lanmon ..... 166/250
3,456,504 7/1969 Bombardieri ..... 73/151

*Primary Examiner*—Jerry W. Myracle
*Attorney, Agent, or Firm*—Hubbard, Thurman, Turner & Tucker

[57] ABSTRACT

Invention permits possible recompletion and rejuvenation of older wells to produce from new zones where the original zone of production has become too depleted for further production. Discloses a method and apparatus for testing an earth formation through a well bore side wall which is covered by steel casing and cement. Includes the steps of establishing a fluid tight seal between the face of the casing and the interior of tester apparatus; providing a source of change in the fluid pressure within the apparatus causing a pressure change only when such a fluid tight seal does exist; releasing a firing mechanism responsive to such fluid pressure change to fire a casing perforating mechanism; perforating a hole through the casing with the perforating mechanism at a position within the fluid tight seal to establish sealed fluid communication between the earth formation and the interior of the apparatus; and testing the earth formation through said hole.

20 Claims, 5 Drawing Figures

SELECTIVE EARTH FORMATION TESTING THROUGH WELL CASING

This invention generally pertains to the testing of potentially fluid bearing earth formations and more particularly pertains to a method and apparatus for testing an earth formation through a hole made through the wall of a well casing cemented within a well bore.

BACKGROUND OF THE INVENTION

The specific embodiment of the invention as disclosed herein is provided for use with a selective formation tester apparatus of the kind disclosed in the Hallmark applications Ser. No. 146,706, Filed May 5, 1980, now U.S. Pat. No. 4,246,782 and Ser. No. 146,681, Filed May 5, 1980 now U.S. Pat. No. 4,248,081. Consequently, these disclosures are specifically incorporated herein by reference and the construction and operation of the selective formation tester apparatus disclosed in these referenced applications will differ in the following description only to the extent as modified to utilize the present invention.

The present invention is an improvement to the apparatus disclosed in the incorporated references in that it enables such tester apparatus to be used in testing earth formations in well bores after well casing has been cemented into place.

A valuable capability of the present invention is to permit the owner or operator of a well which may have been previously completed to produce oil or gas from a particular zone of formation, to subsequently test other potentially productive zones through the well casing. There are a great many wells which were initially completed to produce a zone which subsequently has become too depleted for economic production. In such wells having one or more other zones which are potentially productive, the productive life of that well may be renewed by testing such zones with the present invention and recompleting the well to produce from a more productive zone.

SUMMARY OF THE INVENTION

One object of the present invention is to provide a selective formation tester apparatus which can test earth formations through wall casing and the surrounding cement of a cased well, possibly a well which has been producing previously.

Another object of the present invention is to provide apparatus having a casing perforating mechanism which cannot be fired by stray or spurious electrical currents.

Another object of the present invention is to provide apparatus having a side wall sealing pad which must effect a fluid tight seal before further manipulation of the tester apparatus can be made.

Still another object of the present invention is to provide apparatus where the earth formation is tested through a perforation made through the well casing and surrounding cement with the perforation being made only after the tester apparatus has been set and the seal positively made.

Still another object of the present invention is to provide apparatus having a perforation mechanism which is entirely mechanical in character and which is completely insensitive to mechanical shocks as may occur during the handling of the apparatus on the derrick floor and within the well prior to the testing operation.

These and other objects of the present invention are attained by a method and apparatus for testing an earth formation through the side wall of a well bore which side wall is covered by steel casing and cement. Includes the steps of establishing a fluid tight seal between the face of the casing and the interior of the tester apparatus; providing a source to change the fluid pressure within the apparatus which pressure does change only when such a fluid tight seal does exist; releasing a firing mechanism responsive to such fluid pressure change to fire a casing perforating mechanism; perforating a hole with the perforating mechanism through the casing at a position within the fluid tight seal to establish sealed fluid communication between the earth formation and the interior of the apparatus; and testing the earth formation.

IN THE DRAWINGS

DESCRIPTION OF THE PREFERRED EMBODIMENT

Figure 1:
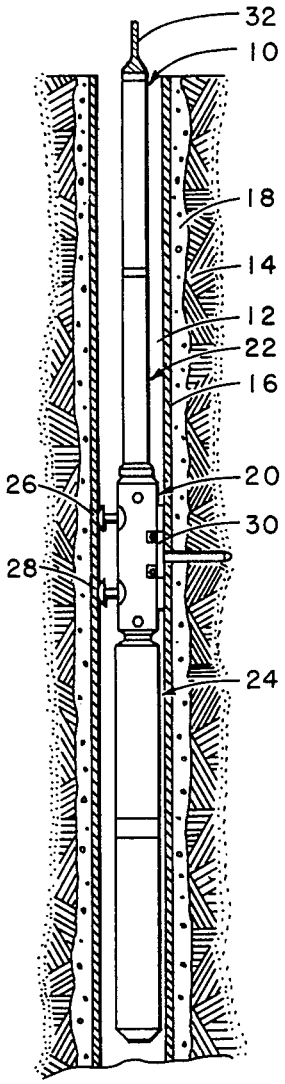
FIG. 1 is a schematic elevational illustration of the tester tool of the present invention as suspended within a well bore and positioned for taking a test of surrounding earth formation.

In FIG. 1, there is shown a tool 10 of the present invention suspended in a borehole 12 driled into a formation 14 to be tested. Emplaced within the borehole 12 is a steel casing 16 cemented into place within the formation 14 with cement 18.

The tool 10 is made up of three primary sections which may be termed the seal pad section 20, the upper tool section 22, and the lower chamber section 24. The seal pad section 20 includes backup pads 26 and 28 and the sealing pad assembly 30.

A cable 32 and a winch means (not shown) by which the tool 10 is suspended and traversed along the borehole, as well as the above ground equipment, are conventional and consquently need not be described herein.

A hydraulic power assembly (not shown) is contained in upper section 22 for generating and controlling hydraulic pressure to extend and set the seal pad means and backup pad means and to release the same. Such hydraulic power assembly generally comprises an electrically driven hydraulic piston and cylinder assembly and related pressure sensing elements.

Also, apparatus for conducting various formation tests and for providing and controlling flow (not shown) may be referred to for convenience as the mini-sample apparatus. The mini-sample apparatus is contained within the upper tool section 22 and comprises an electrically driven mini-sample piston and cylinder assembly.

In addition to the sealing pad assembly 30 and the backup pad assemblies 26 and 28, the seal pad section 20 also carries an equalizer valve assembly 34. The equalizer valve assembly 34 comprises a piston 36, a ring 38, a retainer plug 40, and a bias spring 42. The sample pad block 20 defines a bore 44 for receiving the equalizer valve assembly 34. The inner end of piston 36 sealingly fits within a portion 46 of the pad block bore with an O-ring seal and its outer end fits into a central bore of the seal ring 38. The inner end of the piston is exposed to a hydraulic fluid flow passageway 66 while the outer end is exposed to well bore fluid.

The bias spring 42 bears at one end on the ring 38 and at the other end on a shoulder of piston 36, so as to urge the piston inwardly for a purpose to be hereinafter explained.

The lower tool section 24 includes a sample chamber means (not shown) of conventional design which consequently will not be described herein.

The piston backup pad assembly 26 is seen to comprise a backup pad 50 attached to a piston 52 which is retained in its cylinder by means of a retainer 54 and with the other end of the cylinder closed off by means of a cylinder cover 56. The piston 52 is hydraulically sealed within its cylinder by means of O-ring seals as shown.

Likewise, backup pad assembly 28 is seen to comprise a backup pad 58 attached to a piston 60 which is retained in its cylinder by a retainer 62 with the other end of the cylinder closed off by means of a cylinder cover 64. As shown, appropriate O-ring seals are also provided to hydraulically seal the piston 60 within its cylinder.

A hydraulic fluid passageway 66 extends downwardly from the upper tool section 22 through the seal pad section 20 to provide fluid communication from the upper tool section to piston 52 and to piston 56 as shown. As later described, fluid pressure is directed into passageway 66 from the upper tool section 22 to cause the pistons 52 and 60 to be extended and force the tool 10, including the seal pad section 20 and the sealing pad assembly 30, to one side of the well casing 16 with the pad 30 being forced into intimate contact with the inner wall of the casing 16.

Figure 2A:
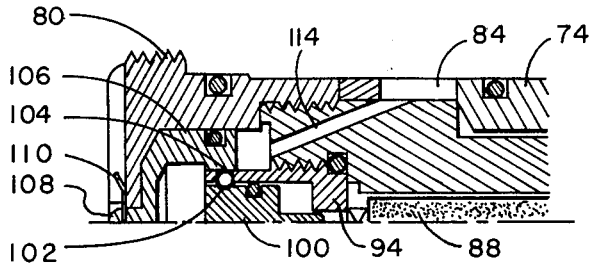
FIG. 2A is an enlarged portion of FIG. 2 showing the firing mechanism in greater detail.
Figure 2:
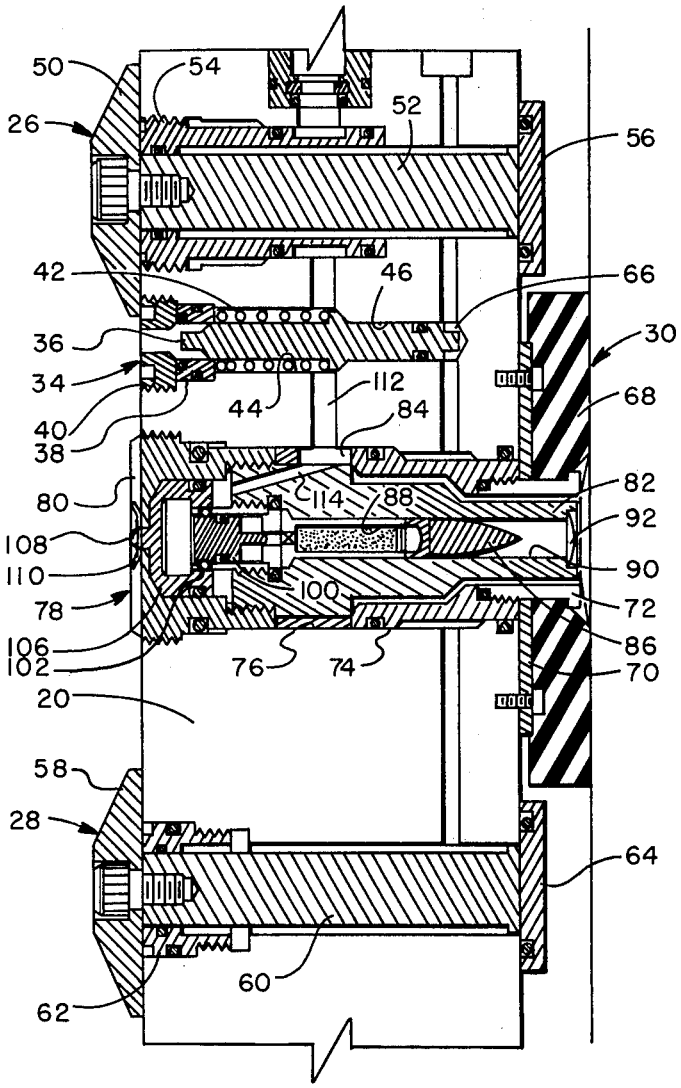
FIG. 2 is a longitudinal cross-sectional elevation of the sealing section and perforating mechanism of the well tester as shown in retracted position while the tester is being positioned in the well bore.
Figure 3:
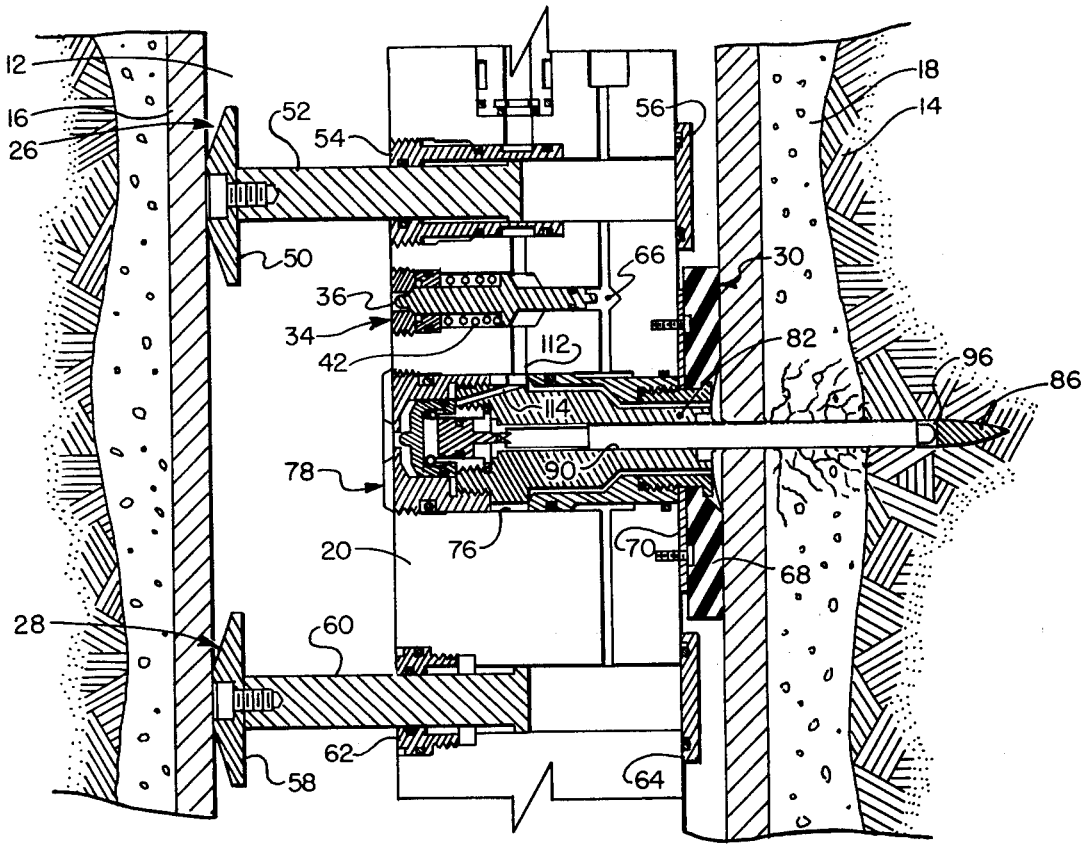
FIG. 3 is the sealing section of FIG. 2 and illustrating the sealing member in sealing position following perforation of the well casing for the performance of the various tests as made by the tester apparatus.

As seen in FIGS. 2 and 3, the sealing pad assembly 30 is comprised of a resilient sealing pad 68, provided of neoprene or the like, which is backed up by a sealing pad plate 70. The pad plate 70 is threadedly secured to pad section 20 as shown. The sealing pad assembly 30 is retained with the pad section 20 by means of a threaded outer pad retainer 72 connected into an inner retainer 74 which is in turn mounted with a counterbored chamber 76 in sealed relation with appropriate O-rings as shown.

It is to be noted that the counterbored chamber 76 is the same chamber which contained the extendable sealing pad piston assembly disclosed in application Ser. No. 146,706, which disclosure has been incorporated herein by reference. Threaded into the opposite end of the counterbored chamber 76 is a casing perforating assembly 78.

The casing perforating assembly 78 generally includes a retainer plug 80 threaded into the bore 76. The plug 80 has threaded into its interior end a gun barrel 82. Disposed between the retainer plug 80 and the inner retainer 74 is a ventilated barrel support spacer 84 which is provided in the nature of a perforated sleeve.

The gun barrel 82 is bored to receive a bullet projectile 86 and an explosive cartridge 88, as shown, in a bore 90. The bullet projectile 86 includes a soft metal (such as brass) gas seal 96 which is commonly used in casing perforating guns of the bullet type.

The muzzle end of the bore 90 is counterbored to receive a dome shaped sealing disc 92 which is pressed into place to provide an initial seal. Later applied fluid pressure imposed on the outside of the sealing disc 92 increases such fluid seal responsive to the dome shape as familiar to those skilled in the art.

Threaded into the breech end of the bore 90 is a breech bushing 94 which serves to retain the cartridge 88 into position for firing, as later described.

The breech bushing 94 has a bore through its axis to receive the firing pin 98 extending from a firing piston 100 which is slidingly received into a counterbore also defined within the breech bushing 94. The piston 100, sealed by an O-ring within the breech bushing 94, defines an air filled chamber as shown.

The firing piston 100 defines a circumferential groove which receives a plurality of latch balls 102 which are mounted in a plurality of holes circumferentially disposed around the outer end of the breech bushing 94.

The latch balls 102 are retained within their respective holes and within the groove in firing piston 100 by a retainer surface 104 defined in a retainer bonnet 106. The retainer surface 104 of the retainer bonnet 106 is adapted to fit neatly around the outer surface of breech bushing 94 such that the latch balls 102 are retained totally within the breech bushing holes and the firing piston groove, thereby latching the firing piston 100 against any longitudinal movement as better shown in FIG. 2A.

The bonnet 106 is slidably mounted in sealed relation with an O-ring seal within a bore of retainer plug 80 as shown. The retainer surface 104 is undercut within the bonnet 106 to provide a cavity of increased diameter as shown in FIGS. 2, 2A and 3.

A retainer nipple 108 is provided at the axis and on the outer side of the bonnet 106. The nipple 108 extends through a hole provided in the retainer plug 80 to the exterior of the plug and the tool section 20.

A transverse hole defined in the outer end of the nipple 108 receives a retainer shear pin 110 disposed outside plug 80. The shear pin 110 is provided to be sheared and thereby permit movement of the bonnet 106 upon application of a sufficient deferential pressure applied from the outside of the tool 10 to within the bonnet 106 as later described.

A fluid passageway 112 extends longitudinally through the seal pad section 20 from its upper end as shown into the ventilated portion of the spacer 84. From spacer 84, the fluid passageway 112 has pressure and flow communication between the gun barrel 82 and the inner retainer 74 and outer retainer 72 to the exterior face of the sealing pad 68.

The passageway 112 also has fluid communication through the spacer 84 and a bore 114 defined through the gun barrel 82 as shown into a chamber defined between the bonnet 106 and the breech end of the gun barrel 82 and also into the cavity defined within the undercut portion of the bonnet 106.

In the perforating assembly 78 as shown, the firing piston 100 with its firing pin 98 is seen to be in "cocked" position in readiness to strike the primer of the cartridge 88.

The cartridge 88 may be of 0.38 "Police Special" caliber reloaded with "Bullseye" gun powder as manufactured by the Hercules Powder Company, 84 Fifth Avenue, New York, N.Y. 10011. This powder is a fast burning, pistol-type powder found particularly suitable to project the bullet 86 through the steel casing 16 and surrounding cement 18 to provide a drainage hole in the earth formation 14.

OPERATION OF THE PREFERRED EMBODIMENT

In operation the well tool 10 is lowered into the well bore 12 in suspension from the electrical cable 32 to a depth of formation where it is desired to ascertain the fluid content and formation pressure of the formation. As the tool 10 is run into the formation, all the elements are in the positions shown in FIG. 2.

When the tool 10 is stopped at the depth of the earth formation to be tested, the operator energizes the setting motor to force hydraulic fluid through the passageway 66 to the pistons 52 and 60 to move the backup pads 50 and 58 outwardly from the tool 10 and thereby urge the tool 10 and the sealing pad 68 into contact with the side wall of the casing 16 with the backup pads being urged against the opposite wall of casing 16 as shown in FIGS. 1 and 3.

It is to be noted that the pressure within passageway 66 extends the piston 36 against a seal in retainer plug 40 to isolate the passageway 112 from the hydrostatic pressure in the well bore.

When the hydraulic fluid pressure in the passageway 66, and beneath pistons 52 and 60, have reached the pressure of 1000 psi, for example (above the hydrostatic well bore pressure existing in the well bore 12), then the sealing pad 68 is considered to be set in fluid tight relationship against casings 16 and thus isolating a portion of the casing at the muzzle of gun barrel 82 from the hydrostatic pressure found in well bore 12. The hydrostatic pressure in well bore 12 may be at a pressure of 2000 psi, for example, as created by a column of liquid such as water within the well bore.

The operator next actuates the mini-sample motor to cause the volume of the mini-sample chamber to increase and thereby decrease the fluid pressure in the fluid passageway 112. If a fluid tight seal in fact exists between the sealing pad 68 and the inner face of the steel casing 16, then the fluid pressure within the fluid passageway 112 begins to decrease from the original pressure which existed in the passageway before the sealing pad 68 was set into sealing position. At such time as the fluid pressure within the fluid passageway 112 decreases to a designated extent below the hydrostatic pressure, 200 psi for example, then the hydrostatic pressure in the well bore 12 is imposed across the head of the bonnet 106 to an extent causing the retainer shear pin 110 to shear and part. Shearing of the pin 110 permits the bonnet to move interiorly into the cavity defined at the breech of the gun barrel 82. Movement of the bonnet 106 also moves the retainer surface 104 to a position where the latch balls 102 are free to move out of their respective holes located in the breech bushing 94 into the cavity defined in the bonet 106 as shown in FIG. 3.

As the latch balls 102 move out of the groove around the firing piston 100, the firing piston is released from its latched position and moves very rapidly, in response to the pressure remaining in the fluid passageway 112, into the air cavity provided in the interior of the breech bushing 94.

Rapid movement of the firing piston 100 also carries the firing pin 98 into percussive impact with the primer of the cartridge 88, thereby igniting the powder charge in the cartridge. The expanding gas from the cartridge 88 drives the bullet projectile 86 very rapidly out the bore of the gun barrel 82 through the sealing plug 92, the casing 16 and the cement 18 into the earth formation 14 as shown in FIG. 3.

The impact of the bullet 86 on the cement 18 and the well formation 14 causes cracks and fissures in the cement and earth formation which will permit fluid flow and pressure to be transmitted from the formation through the hole and the casing 16 and through the previously described passageway between the gun barrel 82 and the retainers 72 and 74 into the fluid passageway 112.

After the perforation has been made into the formation 14 as described, the operator, assured of a good fluid tight seal between the sealing pad 68 and the face of the steel casing 16, may go through the procedures of pressure test, flow test, and fluid sample withdrawal as described more fully in the incoporated reference application Ser. No. 146,706.

DESCRIPTION OF AN ALTERNATE EMBODIMENT

Figure 4:
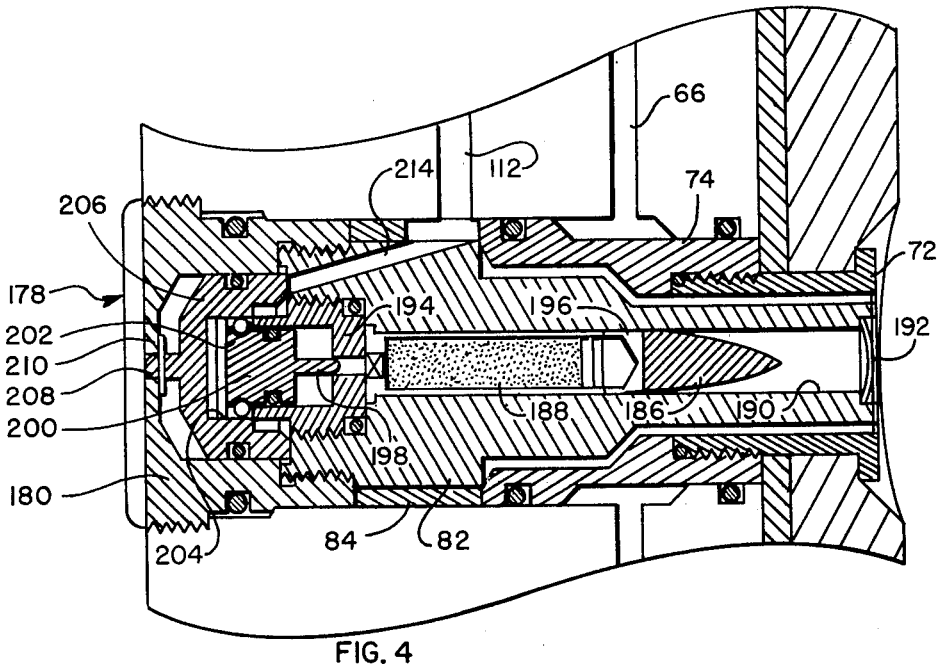
FIG. 4 is an alternate embodiment of the structure illustrated in FIG. 2.

As shown in FIG. 4, an alternate embodiment includes the same counterbored chamber 76 as shown in FIGS. 2 and 3.

With the embodiment of FIG. 4, the tool 10 may be used in cased well bores containing little or no liquid and consequently with little or no hydrostatic pressure developed around the well tool 10.

The casing perforating assembly 178 generally includes a retainer plug 180 threaded into the bore 76. The plug 180 has threaded into its interior end a gun barrel 182. Disposed between the retainer plug 180 and the inner retainer 74 is the ventilated barrel support spacer 84 which is provided in the nature of a perforated sleeve.

The gun barrel 182 is bored to receive a bullet projectile 186 and an explosive cartridge 188, as shown, in a bore 190. The bullet projectile 186 includes a soft metal (such as brass) gas seal 196 which is commonly used in casing perforating guns of the bullet type. The muzzle end of the bore 190 is counterbored to receive a dome shaped sealing disc 192 which is pressed into place to provide an initial seal. Threaded into the breech end of the bore 190 is a breech bushing 194 which serves to retain the cartridge 188 into position for firing.

The breech bushing 194 has a bore through its axis to receive the firing pin 198 extending from a firing piston 200 which is slidingly received into a counterbore also defined within the breech bushing 194. The piston 200, sealed by an O-ring within the breech bushing 194, defines an air filled chamber as shown. The firing piston 200 defines a circumferential groove which receives a plurality of latch balls 202 which are mounted in a plurality of holes circumferentially disposed around the outer end of the breech bushing 194.

The latch balls 202 are retained within their respective holes and within the groove in firing piston 200 by a retainer surface 204 defined in a retainer bonnet 206. The retainer surface 204 of the retainer bonnet 206 is adapted to fit neatly around the outer surface of breech bushing 194 such that the latch balls 202 are retained totally within the breech bushing holes and the firing piston groove, thereby latching the firing piston 200 against any longitudinal movement.

The bonnet 206 is slidably mounted in sealed relation with an O-ring seal within a bore of retainer plug 180 as shown. The retainer surface 204 is undercut into the bonnet 206 to provide a counterbore of increased diameter as shown. A retainer nipple 208 is provided at the axis and on the outer side of the bonnet 206. The nipple 208 extends through a hole provided in the retainer plug 180 to the exterior of the plug and the tool section 20.

A transverse hole defined through the diameter of the nipple 208 receives a retainer shear pin 210 disposed within the plug 180 when assembled as shown. The shear pin 210 is provided to be sheared and thereby permit movement of the bonnet 206 upon application of a sufficient deferential pressure applied from within the bonnet 206 to the outside of tool 10 as later described.

The fluid passageway 112 extending longitudinally through the seal pad section 20 as shown extends into the ventilated portion of the spacer 84. From spacer 84, the fluid passageway 112 has pressure and flow communication between the gun barrel 182 and the inner retainer 74 and outer retainer 72 to the exterior face of the sealing pad 68.

The passageway 112 also has fluid communication through the spacer 84 and a bore 214 defined through the gun barrel 182 into a chamber defined between the bonnet 206 and the breech end of the gun barrel 182 and also into the cavity defined within the counterbored portion of the bonnet 206.

In the perforating assembly 178 shown in FIG. 4, the firing piston 200 with its firing pin 198 is seen to be in "cocked" position in readiness to strike the primer of the cartridge 188.

In operation of the embodiment of FIG. 4, the tool 10 is lowered into the well bore 12 in suspension from the electrical cable 32 to a depth of formation where it is desired to ascertain the fluid content and formation pressure of the formation. With the embodiment of FIG. 4, the tool 10 may be used in cased well bores containing little or no liquid and consequently with little or no hydrostatic pressure developed around the well tool 10.

When the tool 10 is stopped at the depth of the earth formation to be tested, the operator energizes the setting motor to force hydraulic fluid through the passageway 66 to the pistons 52 and 60 to move the backup pads 50 and 58 outwardly from the tool 10 and thereby urge the tool 10 and the sealing pad 68 into contact with the side wall of the casing 16 with the backup pads being urged against the opposite wall of casing 16 as previously described.

The hydraulic fluid pressure in the passageway 66, and beneath pistons 52 and 60, is applied to set the sealing pad 68 in fluid tight relationship against the casing as previously described The operator next actuates the mini-sample motor to cause the volume of the mini-sample chamber to decrease and thereby increase the fluid pressure in the fluid passageway 112. If a fluid tight seal in fact exists between the sealing pad 68 and the inner face of the steel casing 16, then the fluid pressure within the fluid passageway 112 begins to increase from the original pressure which existed in the passageway before the sealing pad 68 was set into sealing position.

At such time as the fluid pressure within the fluid passageway 112 increases to a designated extent above the hydrostatic pressure, 500 psi for example, the applied pressure is imposed as a differential pressure across the head of the bonnet 206 to an extent causing the retainer shear pin 210 to shear and part. Shearing of the pin 210 permits the bonnet to move further into the plug 180. Movement of the bonnet 206 also moves the retainer surface 204 to a position where the latch balls 202 are free to move out of their respective holes located in the breech bushing 194 and into the counterbore of the bonnet 206.

As the latch balls 202 move out of the groove around the firing piston 200, the firing piston is released from its latched position and moves very rapidly, in response to the pressure remaining in the fluid passageway 112, into the air cavity provided in the interior of the breech bushing 194.

Rapid movement of the firing piston 100 also carries the firing pin 198 into percussive impact with the primer of the cartridge 188, thereby igniting the powder charge in the cartridge. The expanding gas from the cartridge 188 drives the bullet projectile 186 very rapidly out the bore of the gun barrel 182 through the casing 16 and the cement 18 into the earth formation 14 as previously described and shown in FIG. 3.

After perforation has been made into the formation 14 as described, the operator, assured of a good fluid tight seal between the sealing pad 68 and the face of the steel casing 16, may go through the procedures of pressure test, flow test, and fluid sample withdrawal as previously described.

It is to be noted that a bullet type perforating gun assembly is herein provided as the preferred embodiment. As evident, a shaped "jet charge" assembly provided with a similar mechanical ignition mechanism may also be provided. The bullet type perforator is considered preferable because the bullet does cause cracks and fissures in the cement and formation to permit fluid flow whereas the jet charge does not cause fissures and cracks to the same extent. The bullet gun is also less expensive to make in small lots and has a longer shooting life.

As can be seen, the present invention permits a selective formation tester of the general kind described with reference to tool 10 to perform tests in well bores after the wells have been completed with a permanent installation of well casing. As previously mentioned, these wells may have been completed to produce a zone which has since become depleted.

Though only two embodiments of the invention have been illustrated and described herein, it will be obvious to those skilled in the art that modifications and changes may be made to the invention, all within the perview of the following claims.

I claim:

1. A method of testing earth formation through the wall of a well casing, comprising the steps of:

(a) placing a formation testing means within said well casing at a position adjacent the earth formation to be tested;

(b) establishing a fluid tight seal between the interior face of said casing and said testing means to permit fluid pressure and flow communication solely between said interior face and the interior of said testing means;

(c) providing a designated potential fluid pressure change from within said testing means to said interior face which becomes an actual pressure change when said seal proves to be actually fluid tight;

(d) releasing a pressure responsive firing means in response to said actual pressure change to actuate a casing perforating means;

(e) perforating a hole through said casing and into said formation at a position surrounded by said fluid tight seal to establish fluid communication solely between said formation and the interior of said testing means; and (f) testing said earth formation through said hole.

2. The method of claim 1 wherein said pressure change is a decrease in pressure.

3. The method of claim 2 wherein said firing means is actuated by a differential pressure imposed by the well bore hydrostatic pressure toward a lesser pressure within said testing means.

4. The method of claim 1 wherein said pressure change is an increase in pressure.

5. The method of claim 4 wherein said firing means is actuated by said increase in pressure.

6. The method of claim 1 wherein said firing means may be actuated only when said seal proves to be actually fluid pressure tight.

7. The method of claim 1 further including the step of providing a hydraulic pressure within said testing means to establish said fluid tight seal.

8. The method of claim 7 wherein the sole said fluid communications is established by the provision of said hydraulic pressure.

9. Apparatus for testing earth formations through the wall of a well casing, comprising:

(a) formation testing means adapted to be placed within said well casing at a position adjacent the earth formation to be tested;

(b) sealing means for establishing a fluid tight seal between the interior face of said casing and said testing means; said means permitting fluid pressure and flow communication solely between said interior face and the interior of said testing means;

(c) a changeable pressure source for providing a designated potential fluid pressure change from within said testing means to said interior face which becomes an actual pressure change when said seal proves to be actually fluid tight;

(d) a pressure responsive actuating means responsive to said pressure change for firing a casing perforating means;

(e) perforating means responsive to said firing means for perforating a hole through said casing and into said formation at a position surrounded by said fluid tight seal; and (f) tester means for testing said earth formation through said hole.

10. The apparatus of claim 9 wherein said pressure change is a decrease in pressure.

11. The apparatus of claim 9 wherein said pressure change is an increase in pressure.

12. The apparatus of claim 11 wherein said gun perforator is actuated by an increase in pressure.

13. The apparatus of claim 9 wherein said perforating means comprises a bullet type gun perforator.

14. The apparatus of claim 13 wherein said gun perforator is actuated by differential imposed by the well bore hydrostatic pressure toward a lesser pressure within said testing means.

15. The apparatus of claim 14 wherein said differential pressure may be imposed only when said seal is actually fluid tight.

16. The apparatus of claim 12 wherein said gun perforator includes a percussion type propellant charge.

17. The apparatus of claim 9 wherein said sealing means includes a resilient sealing pad means pressed against said interior face by hydraulic pressure imposed from within said tester means.

18. The apparatus of claim 17 including equalizing valve means responsive to said hydraulic pressure to close off the sole said fluid communication from the well bore hydrostatic pressure.

19. A method of testing earth formation through the wall of a well casing, comprising the steps of:

(a) lowering a wireline suspended formation testing means within said well casing to a position adjacent the earth formation to be tested;

(b) establishing a fluid tight seal between the interior face of said casing and said testing means to permit fluid pressure and flow communication solely between said interior face and the interior of said testing means;

(c) providing a designated potential fluid pressure change from within said testing means to said interior face which becomes an actual pressure change when said seal proves to be actually fluid tight;

(d) initiating a firing means in response to said actual pressure change to actuate a casing perforating means;

(e) perforating a hole through said casing and into said formation at a position surrounded by said fluid tight seal to establish fluid communication solely between said formation and the interior of said testing means; and (f) testing said earth formation through said hole.

20. The method of claim 19 wherein said firing means may be actuated only when said seal proves to be actually fluid pressure tight.

* * * * *

UNITED STATES PATENT AND TRADEMARK OFFICE

CERTIFICATE OF CORRECTION

PATENT NO. : 4,369,654

DATED : January 25, 1983

INVENTOR(S) : Bobby J. Hallmark

It is certified that error appears in the above-identified patent and that said Letters Patent is hereby corrected as shown below:

Column 1, Line 47, "wall" should be --well--.

Column 2, Line 42, "driled" should be --drilled--.

Column 5, Line 59, "bonet" should be --bonnet--.

Column 9, Line 25, "communications" should be --communication--.

Signed and Sealed this

Tenth Day of July 1984

[SEAL]

*Attest:*

GERALD J. MOSSINGHOFF

*Attesting Officer*

*Commissioner of Patents and Trademarks*